US008044606B2

(12) United States Patent
Chang et al.

(10) Patent No.: US 8,044,606 B2
(45) Date of Patent: Oct. 25, 2011

(54) POWER SUPPLY FOR SUPPLYING POWER TO A LAMP

(75) Inventors: Shih-Hsien Chang, Taoyuan Hsien (TW); Ming-Chih Hsieh, Taoyuan Hsien (TW); Hong-Chih Lee, Taoyuan Hsien (TW); Yao-Tien Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 590 days.

(21) Appl. No.: 12/145,017

(22) Filed: Jun. 24, 2008

(65) Prior Publication Data

US 2009/0058313 A1 Mar. 5, 2009

(30) Foreign Application Priority Data

Aug. 30, 2007 (TW) ..... 96132331 A
Sep. 21, 2007 (TW) ..... 96135349 A
Oct. 24, 2007 (TW) ..... 96139818 A
Nov. 15, 2007 (TW) ..... 96143207 A
Apr. 9, 2008 (TW) ..... 97112847 A

(51) Int. Cl.
*H05B 37/00* (2006.01)

(52) U.S. Cl. ..... 315/291; 315/276

(58) Field of Classification Search ..... 315/209 R, 315/224, 225, 276, 291, 307–309
See application file for complete search history.

(56) References Cited

U.S. PATENT DOCUMENTS 7,339,329 B2 3/2008 Makimura et al.
7,619,368 B2 * 11/2009 Lu ..... 315/209 R
7,633,776 B2 * 12/2009 Usui ..... 363/56.11
7,808,191 B2 * 10/2010 Wu ..... 315/307
2005/0023995 A1 * 2/2005 Ohnishi et al. ..... 315/291

FOREIGN PATENT DOCUMENTS

JP 2005243343 A 9/2005

OTHER PUBLICATIONS

First Office Action, mailed Jul. 13, 2011, received in counterpart Chinese Application No. 200710162322.6, 6 pgs.
English translation of First Office Action, mailed Jul. 13, 2011, received in counterpart Chinese Application No. 200710162322.6, 8 pgs.
English translation of abstract of JP 2005243343A, 1 pg.

* cited by examiner

*Primary Examiner* — Jacob Y Choi
*Assistant Examiner* — Jimmy Vu
(74) *Attorney, Agent, or Firm* — Holland & Knight LLP; Brian J. Colandreo, Esq.; Jeffrey T. Placker, Esq.

(57) ABSTRACT

A power supply for supplying power to a lamp with functions of dimming, over-current protection, over-voltage protection, arcing protection, and low-temperature start-up is provided. When frequency of the output current exceeds a predetermined value, the power supply is turned off to accomplish a dimming goal and extend lifetime of the lamp. When abnormal statuses such as open-circuited status, short-circuited status, or arcing status occur, a surge current induced by the abnormal statuses may be eliminated to prevent the power supply from being damaged. A high-frequency current detection circuit is configured to detect whether a current supplied to the high-voltage load is a high-frequency current to prevent damage to the electronic elements in the high-voltage load. A current adjusting circuit is configured to adjust an alternating current outputted to a lamp set in response to an environment temperature to supply an adequate alternating current at a low temperature for starting the lamp set.

15 Claims, 6 Drawing Sheets

POWER SUPPLY FOR SUPPLYING POWER TO A LAMP

CROSS-REFERENCE TO RELATED APPLICATIONS

This application claims priority to Taiwan Patent Application No. 096132331, filed on Aug. 30, 2007, Taiwan Patent Application No. 096135349, filed on Sep. 21, 2007, Taiwan Patent Application No. 096139818, filed on Oct. 24, 2007, Taiwan Patent Application No. 096143207, filed on Nov. 15, 2007, and Taiwan Patent Application No. 097112847, filed on Apr. 9, 2008, the disclosures of which are incorporated herein by reference in their entirety.

BACKGROUND OF THE INVENTION

1. Field of the Invention

The present invention relates to a power supply. More particularly, the present invention relates to a power supply for supplying power to a lamp with functions of dimming, over-current protection, over-voltage protection, arcing protection, and low-temperature start-up.

2. Descriptions of the Related Art

Nowadays, lighting has become indispensable to people's life, and commonly using for lighting are still lamps. Generally, in order to drive a lamp to emit light, an alternating current (AC) power supply is required. A frequency of the AC power supply shall match the impedance characteristics of the lamp, i.e., be maintained in a range from 40 KHz to 80 KHz, for driving the lamp. Besides the range, either an excessively high or an excessively low frequency of the AC power supply would result in increased impedance, i.e. a decreased gain, of the lamp.

In order to match up requirements in different surroundings, the power supply of a lamp may also be designed to provide the lamp with adjustable output brightness, i.e., a dimming function. Since the power supply of a lamp typically adopts a pulse width modulation (PWM) design, the dimming function may be accomplished by adjusting a duty cycle of the power supply, or by increasing a frequency of the power supply output to reduce the gain of the lamp.

However, when dimming a lamp with the above methods, there is still energy outputting to the lamp. Since the service life of the lamp is positively related to the illumination duration of the lamp, and the purpose of dimming the lamp is to decrease the output brightness of the lamp, the energy output continued during the dimming process may not only unnecessarily consume electric power, but also shorten service life of the lamp.

Also, the power supply may suffer surge current when open-circuited status, short-circuited status, or arcing status occurs. If the power supply cannot turns off timely when the aforementioned statuses occur, the lamp or the power supply may be damaged by the surge current.

Almost every kind of electrical products has a certain number of electronic elements interconnected via circuits. If there are any defects in the interconnections, for example, two adjacent bare electrical wires, arcing would occur therebetween. The arc is essentially a high-frequency current, which may damage the electronic elements of an electrical product and may further lead to the complete failure of the product.

A popular way to drive multiple lamps simultaneously is to have the lamps connected in parallel and powered by a single power supply module. However, lamps are known to require a larger starting current at a lower environment temperature. Therefore, if the power supply module still supplies a fixed alternating current when the lamps are exposed to a much lower environment temperature, some of the lamps may fail to start. Particularly, the starting voltage of the lamps and the starting voltage differences between the individual lamps will both increase as the environment temperature decrease, thus, preventing the lamps from starting up simultaneously. As a result, the overall applicability of the lamps will be decreased.

Accordingly, efforts still have to be made in the art to provide a dimming circuit that is able to conserve electric power and prolong the service life of the lamp.

SUMMARY OF THE INVENTION

The primary objective of this invention is to provide a power supply comprising a dimming circuit for dimming a lamp. The dimming circuit is configured to gradually decrease output current from a power supply to a lamp when dimming, and turn off the power supply when a frequency of the output current exceeds a pre-determined value. As a result, a dimming function is accomplished and the service life of the lamp is prolonged.

Another objective of this invention is to provide a power supply with an over-current control circuit being configured to turns off the power supply when an over-current signal represents abnormal statuses such as open-circuited status, short-circuited status, or arcing status. Thus, a surge current induced by the abnormal statuses may be eliminated to prevent the power supply from being damaged.

Another objective of this invention is to provide a power supply with a high-frequency current detection circuit. The power supply comprises a current output module configured to provide a current to a high-voltage load; the high-frequency current detection circuit is configured to detect whether a current supplied to the high-voltage load is a high-frequency current to prevent damage to the electronic elements in the high-voltage load. To this end, the high-frequency current detection circuit comprises a first capacitive element, a resistor and a second capacitive element.

Yet an objective of this invention is to provide a power supply with a current adjusting circuit for adjusting an alternating current outputted to a lamp set in response to an environment temperature to supply an adequate alternating current at a low temperature for starting the lamp set. More particularly, according to the present invention, the alternating current is increased at a low temperature to increase the cross voltage of the capacitor (i.e., a passive element in series) connected in series with the lamps, so that the lamps that would otherwise fail to start will obtain an increased starting voltage and light up. In this way, it is possible to start a plurality of lamps, connected in parallel, simultaneously with a single transformer at a low temperature.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

This invention relates to a power supply for supplying power to a lamp with functions of dimming, over-current protection, over-voltage protection, arcing protection, and low-temperature start-up. Embodiments will be described hereinbelow to explain this invention. However, these embodiments are not intended to limit that this invention can only be embodied in any specific context, applications or with particular methods described in these embodiments. Therefore, description of the embodiments is only intended to illustrate this invention, rather than to limit this invention. It should be noted that, in the following embodiments and attached drawings, elements not directly related to this invention are omitted from depiction, and the dimensional relationships among various elements are slightly exaggerated for ease of understanding.

Figure 1:
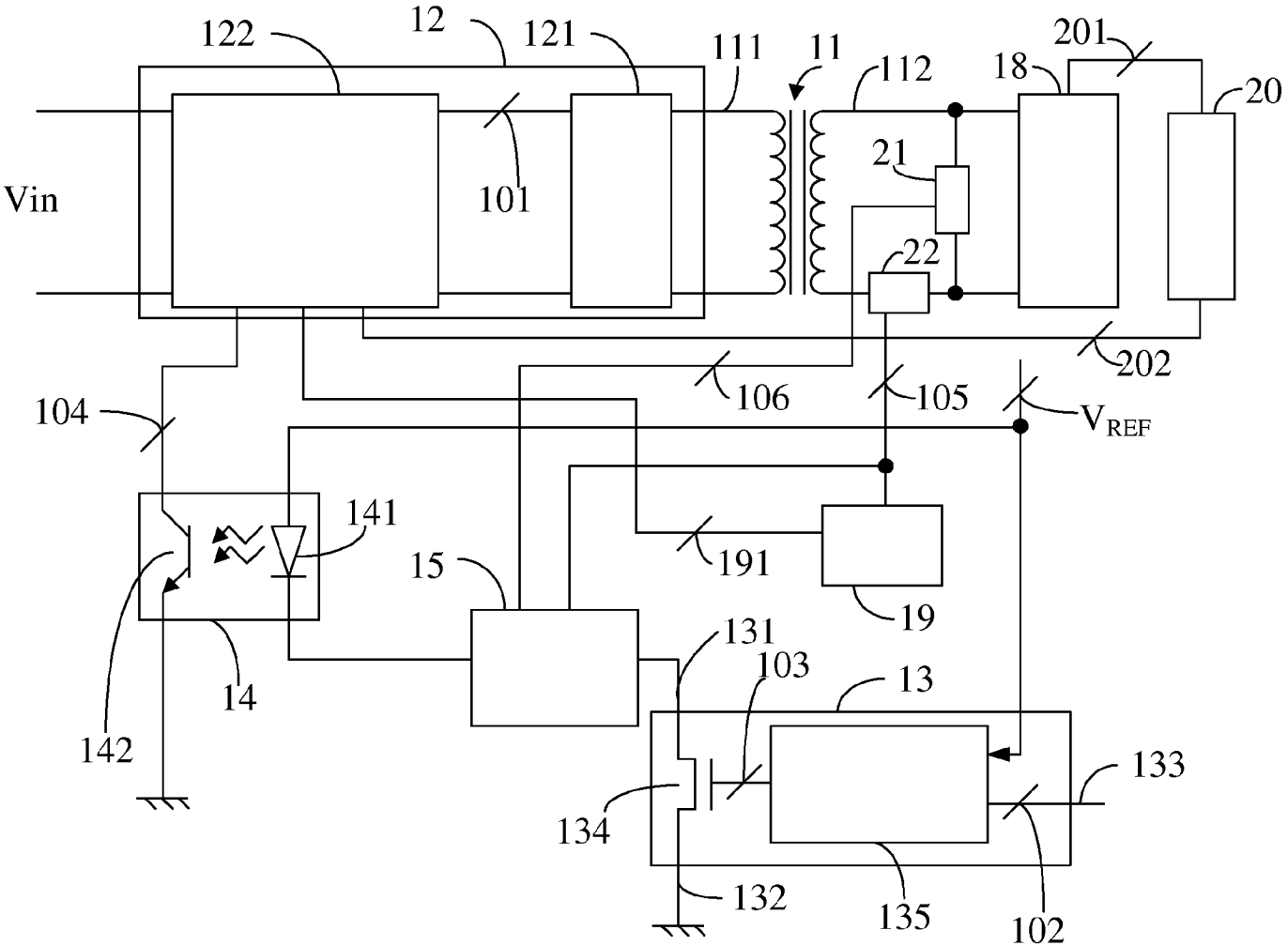
FIG. 1 is a block diagram of a power supply comprising a dimming circuit.

FIG. 1 is a block diagram of a power supply comprising a dimming circuit. The power supply is configured to receive a DC power input Vin and supply an AC output to power a lamp set 18. The power supply comprises an energy transfer element 11, a power control circuit 12, a dimming circuit 13, a photo coupler 14, a protection circuit 15, an over-current control circuit 19, and a high-frequency current detection circuit 20, and the lamp set 18 may comprises a single lamp or a plurality of lamps mutually connected in parallel. In this embodiment, the energy transfer element 11 is a transformer comprising an energy transfer input end 111 and an energy transfer output end 112, and is coupled to an output of the power supply. The power control circuit 12 comprises an energy control circuit 121 coupled to the energy transfer element 11 and a control circuit 122, in which the energy control circuit 121 is configured to receive a control signal 101 from the control circuit 122, in order to supply energy to the energy transfer element 11.

Further, in this embodiment, the dimming circuit 13 comprises three terminals of a first terminal 131, a second terminal 132 and a third terminal 133 respectively, a switching element 134 being a transistor in this embodiment, and a dimming control circuit 135. The switching element 134 is coupled to the first terminal 131 and the second terminal 132, in which the first terminal 131 is coupled to the power control circuit 12 of the power supply, and the second terminal 132 is coupled to a grounding terminal. The dimming control circuit 135 is coupled to the third terminal 133 and the switching element 134, in which the third terminal 133 is adapted to receive a dimming signal 102. The dimming control circuit 135 generates a dimming control signal 103 in response to the dimming signal 102, and also switches the switching element 134 in response to the dimming control signal 103. The power control circuit 12 increases a frequency of the AC output to a frequency range in response to switching of the switching element 134, and turns off the power supply when the frequency exceeds a pre-determined value.

Figure 2:
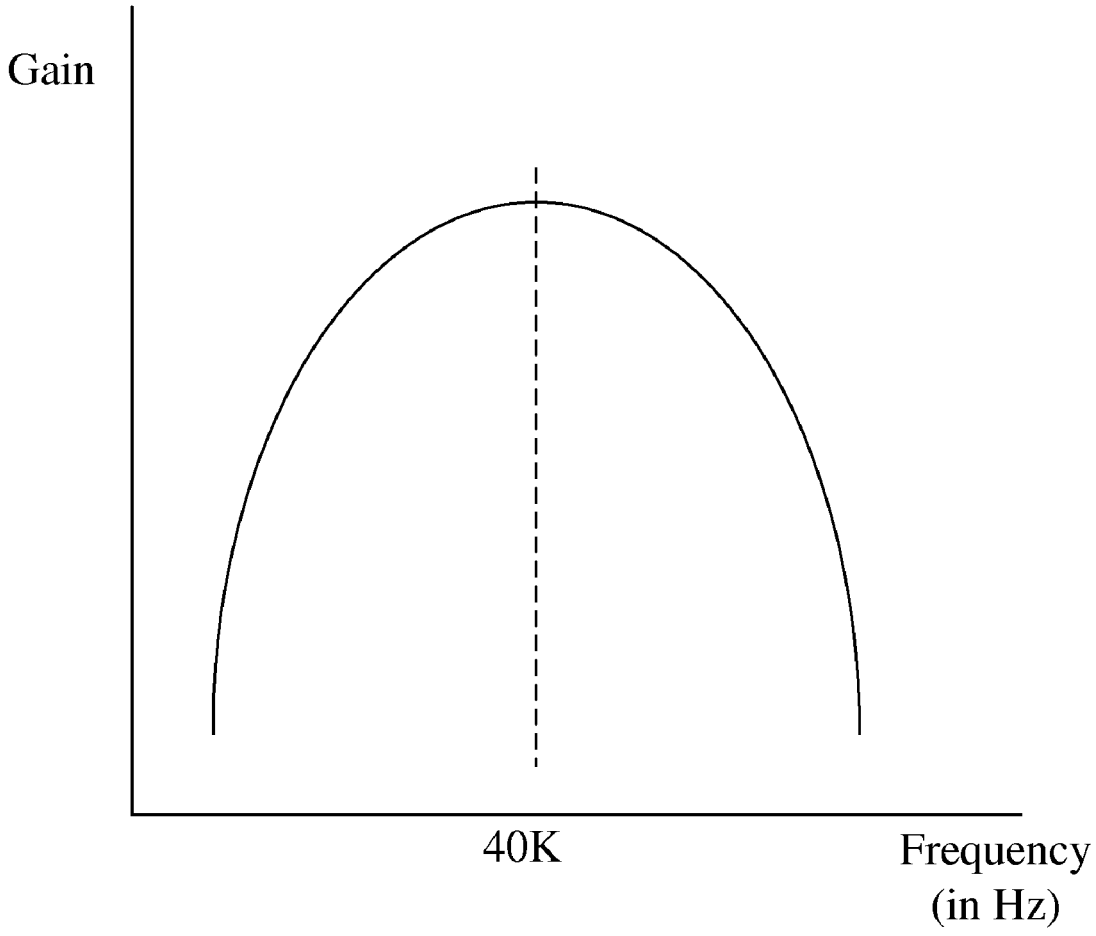
FIG. 2 is a schematic graph of gain versus frequency of a lamp.

Explicitly, the dimming signal 102 from a system comprising the power supply is adapted to adjust brightness of the lamp set 18. Refer to FIG. 2 together, where a schematic graph of gain versus frequency of a lamp is depicted. It can be seen from this figure that, to keep the gain of the lamp at a maximum value, the lamp set 18 shall operate at an appropriate frequency, which generally ranges from 40 KHz to 80 KHz. When the frequency exceeds 40 KHz and keeps increasing continuously, the gain of the lamp will decline. Generally, when the frequency goes higher than 200 KHz, the gain will become very small, i.e., the lamp current will become very small and instable. Therefore, when it is desired to dim the light, the dimming control circuit 135 of the dimming circuit 135 switches the switching element 134 in response to the dimming signal 102, so that the frequency of the AC output of the power control circuit 12 can be increased. At this point, current of the lamp set 18 will decrease gradually as the frequency increases, and once the frequency exceeds a pre-determined value which in this embodiment is 180 KHz, the power supply will be turned off.

Figure 3:
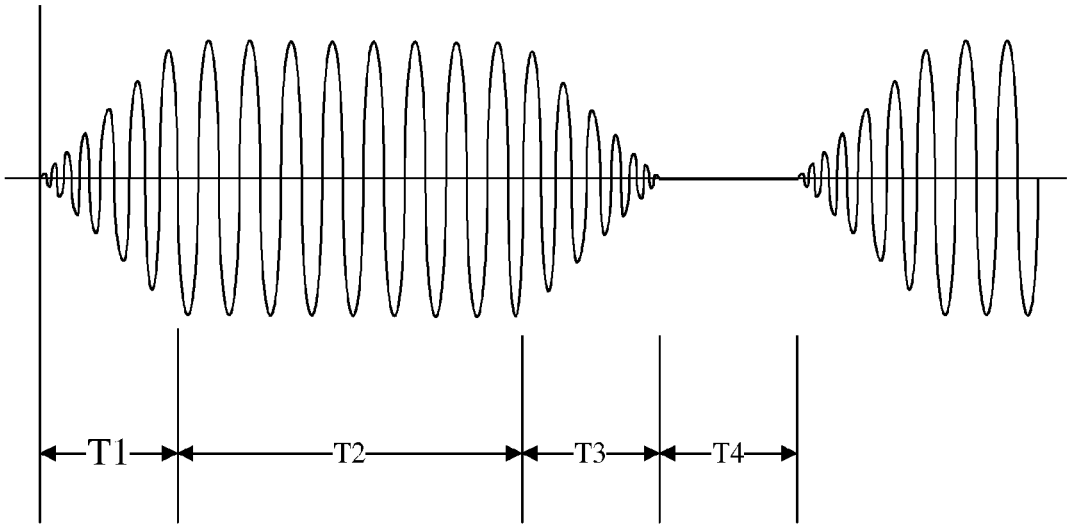
FIG. 3 is a schematic current waveform of a lamp during a dimming process.

Referring to FIG. 3, a schematic current waveform of the lamp set 18 during a dimming process is depicted. The time interval T1 represents the soft-starting characteristics exhibited by the lamp set 18 when started. The time interval T2 represents a current waveform of the lamp set 18 in normal operation, in which case the lamp operates with a substantially fixed frequency value. The time interval T3 represents that a dimming operation is performed on the lamp set 18, in which case the lamp current decreases gradually as the frequency increases from 40 KHz to 180 KHz. The time interval T4 represents that the power supply is turned off when the frequency exceeds a pre-determined value (i.e., 180 KHz), in which case the lamp set 18 has a zero output. By modulating ratio of T4 to T1+T2+T3, the output of the lamp set 18 may be controlled to achieve a dimming effect. For example, when the ratio of T4 to T1+T2+T3 is set at 1:4, the output brightness of the lamp set 18 will be adjusted to 80%.

It should be noted that, the frequency range described above is only taken for an example That is, in other embodiments, the frequency range may be varied in response to the manufacturing characteristics of the lamp, while the pre-determined frequency at which the power supply is turned off may vary accordingly. As the service life of the lamp is positively related to the operation duration thereof, turning off the power supply output may not only accomplish the dimming purpose, but also prolong the service life of the lamp. As manifested by the above embodiments, if the output brightness of the lamp set 18 is adjusted to 50%, the service life of the lamp set 18 will be extended by twice theoretically.

Referring back to FIG. 1, in this embodiment, the photo coupler 14 comprises a light emitting element 141 and a light receiving element 142, in which the light emitting element 141 is coupled to the first terminal 131 of the dimming circuit 13, and the light receiving element 142 is coupled to the power control circuit 12. The dimming control circuit 135 is configured to turn on the switching element 134 in response to the dimming control signal 103. The photo coupler 14 is adapted to generate a coupling signal 104 in response to a turn-on mode of the switching element 134. In response to the coupling signal, the power control circuit 12 increases the frequency of the AC output to the aforesaid frequency range to gradually decrease the peak current of the AC output, and turns off the power supply when the frequency exceeds the aforesaid pre-determined value, i.e., 180 KHz.

The protection circuit 15 is configured to turn off the power supply in case of an excessive output of the power supply, so as to protect the lamp set 18 against damage. The protection circuit 15 is coupled to the output of the power supply via a voltage detection circuit 21 and a current detection circuit 22 for receiving an over-current signal 105 and an over-voltage signal 106, and coupled to the photo coupler 14. The protection 15 may also drive the photo coupler 14 to generate the coupling signal 104 in response to the output of the power supply, thereby to increase frequency of the AC output to the aforesaid frequency range to gradually decrease the peak current thereof and turn off the power supply once the frequency exceeds the aforesaid pre-determined value, i.e., 180 KHz. Embodiments of the protection circuit 15 will be described hereinafter.

Figure 4:
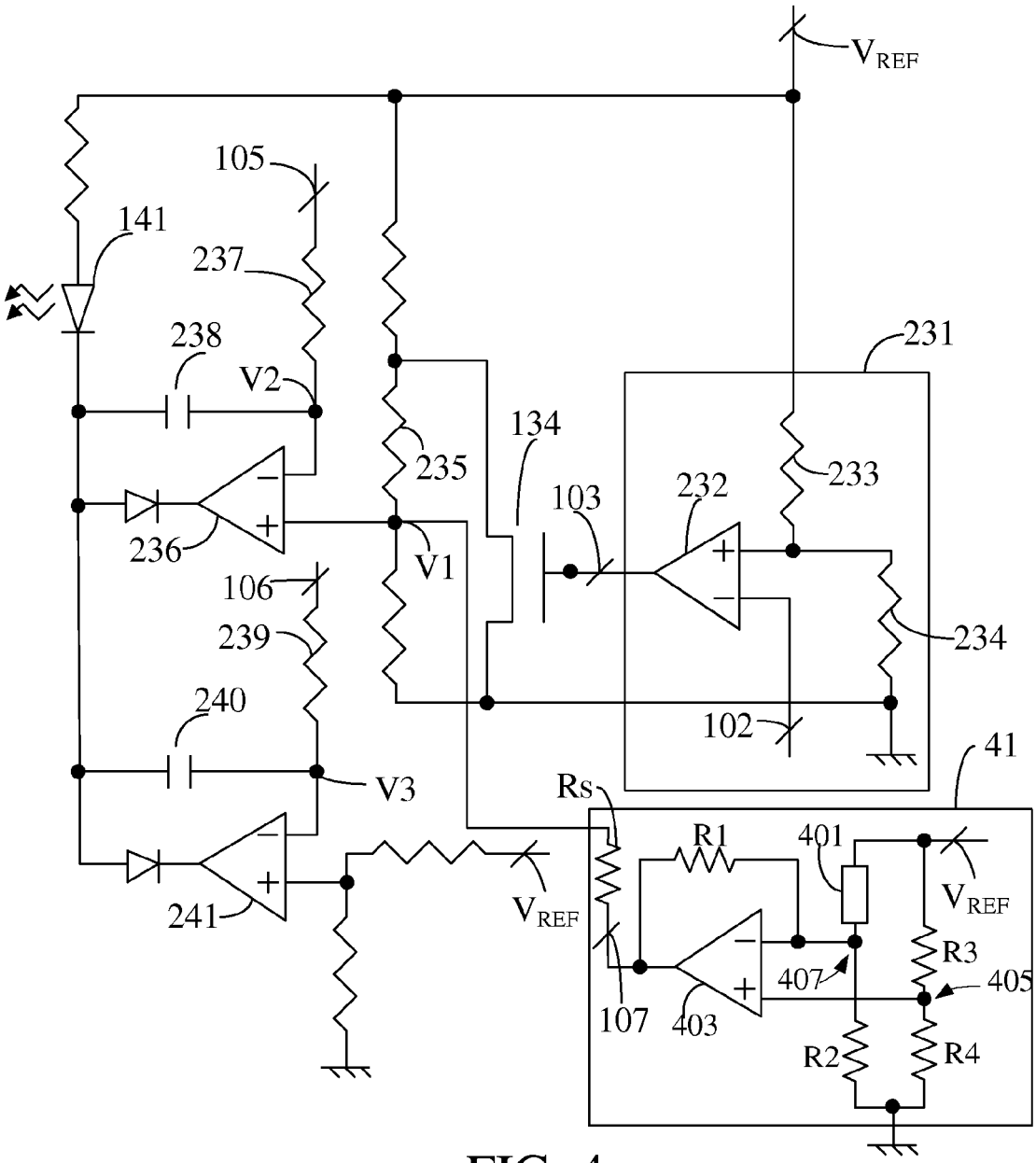
FIG. 4 is a schematic diagram of a dimming circuit, a photo coupler, a protection circuit, and a current adjusting circuit.

Referring to FIG. 4, there is depicted a schematic diagram of parts of the dimming circuit 13, parts of the photo coupler 14, the protection circuit 15, and a current adjusting circuit 41. It should be emphasized that, the protection circuit 15 comprises an over-current protection circuit 151 and an over-voltage protection circuit 152. Further, the dimming signal 102 is an AC signal, for example, a rectangular wave or a pulse signal. The dimming control circuit 135 comprises a comparator circuit 231 configured to compare the dimming signal 102 against a reference value, and generates a dimming control signal 103 in response to the comparing result. The comparator circuit 231 comprises a comparator 232 and two resistors 233, 234. The two resistors 233, 234 form a voltage divider circuit, which is connected to a reference voltage $V_{REF}$ and generates a reference value at one of the input terminals of the comparator 232. The other input terminal of the comparator 232 is connected to the dimming signal 102. When the dimming signal 102 is larger than the reference value, the comparator 232 outputs the dimming control signal 103 to turn on the switching element 134, in which case the input voltage V1 of the comparator 236 will be pulled low by the turn-on current of the switching element 134 through the resistor 235, thus turning on the light receiving element 141 of the photo coupler 14.

In other embodiments, the dimming control circuit 135 may also be amplitude detect circuit, which generates the dimming control signal 103 in response to amplitude of the dimming signal 102 when the amplitude becomes larger than a reference value. The implementation of the amplitude detect circuit may readily occur to those skilled in the art, and will not be described in detail herein.

The over-current protection circuit 151, which comprises a resistor 237 and a capacitor 238, is connected to one of the input terminals of the comparator 236. Upon receiving an over-current signal 105, the over-current protection circuit 151 will have the input voltage V2 of the comparator 236 increased, thereby to turn on the light receiving element 141 of the photo coupler 14. As a result, the lamp current is controlled to prevent damages caused by over-current.

Similarly, the over-voltage protection circuit 152, which comprises a resistor 239 and a capacitor 240, is connected to one of the input terminals of the comparator 241. Upon receiving an over-voltage signal 106, the over-voltage protection circuit 152 will have the input voltage V3 of the comparator 241 increased, thereby to turn on the light receiving element 141 of the photo coupler 14. As a result, the lamp voltage is controlled to prevent damages caused by over-voltage.

The current adjusting current 41 comprises a temperature sensing module 401, and a feedback circuit. The temperature sensing module 401 is configured to sense an environment temperature and to generate a sensing voltage signal at the node 407 in response to the environment temperature. The feedback circuit is coupled to the temperature sensing module 401 to generate a feedback signal 107 in response to the sensing voltage signal, the feedback signal 107 is adapted to modulate the voltage V1 by the resistor Rs. The feedback circuit comprises a comparator 403, resistors R1, R2, R3, R4, and Rs. In the present embodiment, the temperature sensing module 401 is a negative temperature coefficient element.

With this configuration, the reference voltage input 400 will result in a voltage of $$\frac{R4}{R3+R4} \times V_{ref}$$

at nodes 405 and 407, when temperature decrease, the resistance of the negative temperature coefficient element 401 will increase, and result in increase of the voltage at node 107, wherein $V_{ref}$ represents the reference voltage 400. Thus, when the environment temperature decreases, the feedback signal 107 is adapted to decrease the frequency of the AC output.

In other embodiments, the temperature sensing module 401 may be selected from one of a positive temperature coefficient element, a diode, and a combination thereof including the negative temperature coefficient element.

The over-current control circuit 19 is coupled to the AC output of the power supply via the current detection circuit 22. The over-current control circuit 19 is configured to compare the over-current signal 105 with a first reference and a second reference, in which the first reference is larger than the second reference. When the over-current signal 105 is larger than the first reference or when the over-current signal is lower than the second reference, the over-current control circuit 19 generates a judgment signal 191 to the power control circuit 12, and the power control circuit 12 turns off the power supply when the judgment signal 191 is larger than a judgment reference. Therefore the surge current occurred by the open-circuited status, short-circuited status, or arcing status can be prevented. Embodiments of the over-current control circuit 19 will be described hereinafter.

Figure 5:
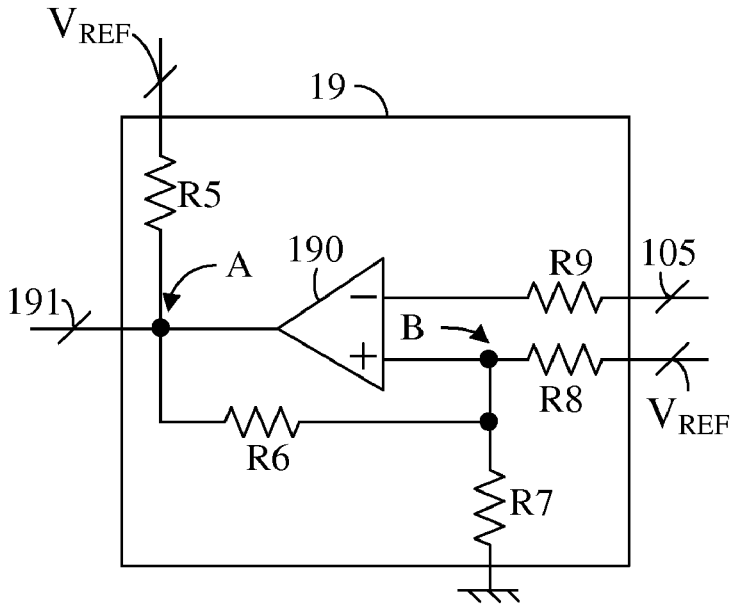
FIG. 5 is a schematic diagram of an over-current control circuit.

FIG. 5 a schematic diagram of the over-current control circuit 19 comprising a comparator 190, a first resistor R5, a second resistor R6, a third resistor R7, a fourth resistor R8, and a fifth resistor R9. The comparator 190 has an inverting end, a non-inverting end, and an output end. The first resistor R5 has a first end and a second end, wherein the first end coupled to a reference Vref, and the second end coupled to the output end of the comparator. The second resistor R6 has a first end and a second end, wherein the first end is coupled to the output of the comparator, and the second end is coupled to the non-inverting end. The third resistor R7 has a first end and a second end, wherein the first end is coupled to the second end of the second resistor, and the second end is coupled to the ground. The fourth resistor R8 has a first end and a second end, wherein the first end is coupled to the first end of the third resistor, and the second end is coupled to the reference Vref. The fifth resistor R9 has a first end and a second end, wherein the first end is coupled to the inverting end, and the second is coupled to the over-current signal 105. The first reference is generated at the node B according to the fundamental principle of electrical divider, and similarly, the second reference is generated at the node A. By the aforementioned circuitry of the over-current control circuit 19, the judgment signal is a square periodical signal.

The high high-frequency current detection circuit 20 is coupled to the AC output of the power supply via the current detection circuit 22.

The high-frequency current detection circuit 20 is coupled to the current output module 2, and is adapted to receive a current 201 of the AC output of the power supply and, in response to a frequency of the current 201, to generate a high-frequency current detecting signal 202. The power control circuit 12 is configured to turn off the power supply when the frequency exceeds a high-frequency reference.

Figure 6:
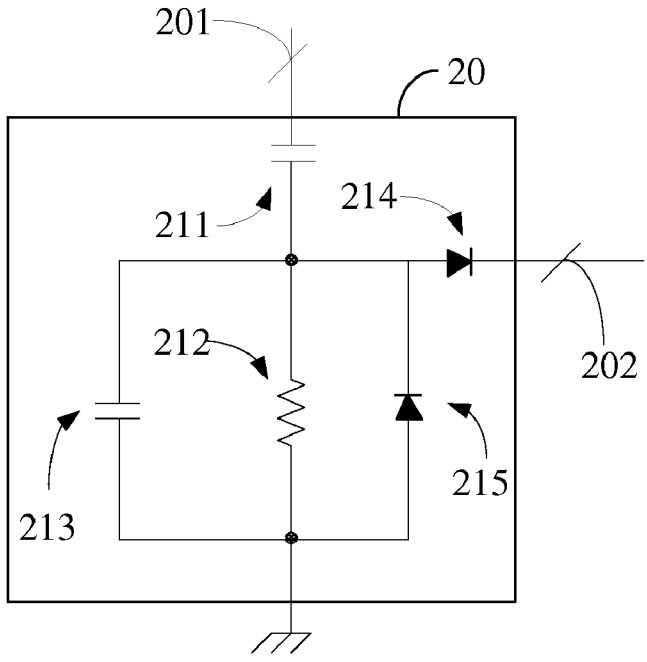
FIG. 6 is a schematic diagram of a high-frequency current detection circuit.

Next, the structure of the high-frequency current detection circuit 20 will be described. As shown in FIG. 6, the high-frequency current detection circuit 20 comprises a first capacitive element 211, a resistor 212, a second capacitive element 213, a first direction element 214 and a second direction element 215. The first capacitive element 211 is coupled to the AC output of the power supply, and is adapted to receive the current 201. The resistor 212 is connected to the first capacitive element 211 in series, and is connected to the second capacitive element 213 in parallel. The first capacitive element 211 and the second capacitive element 213 are adapted to generate the high-frequency current detecting signal 202 at a junction, where they are connected with the resistor 212, in response to a frequency variation of the current 201. Additionally, the first direction element 214 is coupled to the first capacitive element 211, the resistor 212 and the second capacitive element 213. The second direction element 215 is connected to the resistor 212 and the second capacitive element 213 in parallel and is also coupled to the first direction element 214 to transmit the high-frequency current detecting signal 202 to the feedback circuit 13. In this preferred embodiment, both the first direction element 214 and the second direction element 215 are diodes, but do not necessarily have to be in other embodiments.

To detect a high-frequency current, the high-frequency current detection circuit 20 is configured to filter out the low-frequency components of the current to retain the high-frequency components thereof. Therefore, in this preferred embodiment, the first capacitive element 211 is a high-voltage capacitor.

Figure 7:
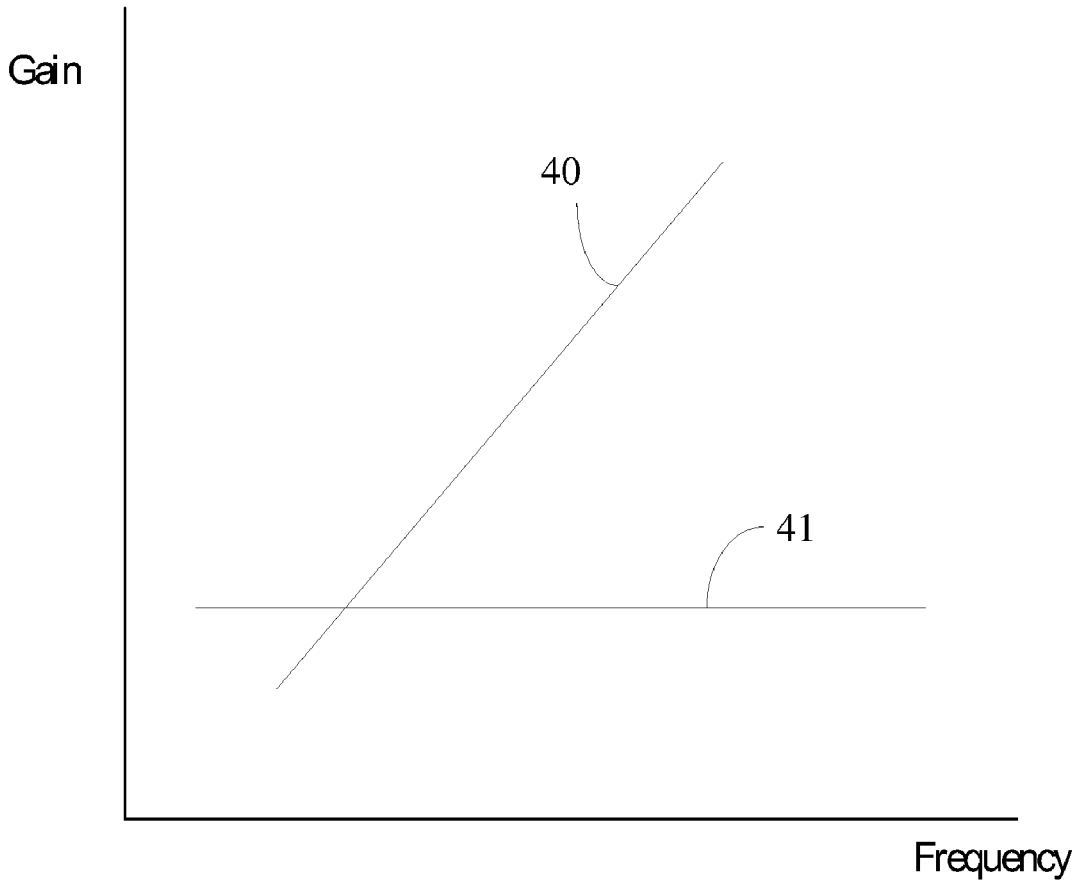
FIG. 7 illustrates the gain versus frequency of a lamp.

FIG. 7 illustrates the gain versus frequency of a lamp. When the second capacitive element 213 has impedance much higher than that of the resistor 212, the gain it produces will be increased as indicated by the line 40. The increased impedance is unfavorable for filtering the high frequency components. In contrast, when the second capacitive element 213 has impedance much lower than that of the resistor 212, it will produce a gain as indicated by the line 41. The decreased impedance is favorable for filtering the high-frequency components successfully. In this embodiment, the second capacitive element 213 is designed to have impedance much lower than that of the resistor 212 to generate the high-frequency current detecting signal 202 by filtering the high-frequency components of the current. In other words, the high-frequency current detection circuit 20 may be considered as a high-pass filter for retaining the high-frequency components of the current.

It should be noted that, the over-current protection circuit and the over-voltage protection circuit are provided to detect excessive power output conditions of the power supply, in order to drive the photo coupler 14 to generate a coupling signal 104 in response to such an output of the power supply. Other embodiments for accomplishing substantially the same protection purpose may readily occur to those skilled in the art, and the scope of this invention is not just limited to the embodiments described above.

It follows from the above description that, this invention provides a dimming circuit capable of conserving electric power and prolonging service life of a lamp. The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A power supply, having an alternating current (AC) output for supplying power to a lamp, the power supply comprising:

an energy transfer element, comprising an energy transfer input end and an energy transfer output end coupled to the output of the power supply;

a power control circuit comprising a energy control circuit coupled to the energy transfer element;

a dimming circuit comprising a switching element and a dimming control circuit, in which the switching element is coupled to the power control circuit, the dimming control circuit is coupled to the switching element and receives a dimming signal, and switches the switching element in response to the dimming signal, the power control circuit increases a frequency of the AC output to a frequency range in response to switching of the switching element, and turns off the power supply when the frequency exceeds a pre-determined value;

a photo coupler coupled to the switching element and the power control circuit, in which the photo coupler generates a coupling signal in response to turn-on mode of the switching element, the power control circuit increases the frequency of the AC output to the frequency range in response to the coupling signal, and turns off the power supply when the frequency exceeds the pre-determined value; and an over-current detect circuit coupled to the output of the power supply and the photo coupler, driving the photo coupler to generate the coupling signal in response to the output of the power supply.

2. The power supply as claimed in claim 1, wherein the power control circuit is selected from a full-bridge control circuit, a half-bridge control circuit, and a push-pull control circuit.

3. The power supply as claimed in claim 1, wherein the dimming control circuit comprises an amplitude detect circuit, generates a dimming control signal for switching the switching element in response to amplitude of the dimming signal.

4. The power supply as claimed in claim 1, wherein the dimming control circuit comprises a comparator circuit being configured to compare the dimming signal with a reference value, and generates a dimming control signal for switching the switching element in response to the comparing result.

5. The power supply as claimed in claim 1, wherein the frequency range is 40K Hz to 180K Hz.

6. The power supply as claimed in claim 1, further comprising an over-current control circuit coupled to the AC output of the power supply, the over-current control circuit being configured to compare an over-current signal with a first reference and a second reference, in which the first reference is larger than the second reference, and the over-current control circuit generates a judgment signal to the power control circuit when the over-current signal is larger than the first reference or when the over-current signal is lower than the second reference, and the power control circuit turns off the power supply when the judgment signal is larger than a judgment reference.

7. The power supply as claimed in claim 6, wherein the judgment signal is a square periodical signal.

8. The power supply as claimed in claim 6, wherein the over-current control circuit comprises:

a comparator, having an inverting end, a non-inverting end, and an output end;

a first resistor, having a first end and a second end, wherein the first end coupled to a reference, and the second end coupled to the output end of the comparator;

a second resistor, having a first end and a second end, wherein the first end is coupled to the output of the comparator, and the second end is coupled to the non-inverting end;

a third resistor, having a first end and a second end, wherein the first end is coupled to the second end of the second resistor, and the second end is coupled to the ground;

a fourth resistor, having a first end and a second end, wherein the first end is coupled to the first end of the third resistor, and the second end is coupled to the reference; and a fifth resistor, having a first end and a second end, wherein the first end is coupled to the inverting end, and the second is coupled to the over-current signal.

9. A power supply, having an alternating current (AC) output for supplying power to a lamp, the power supply comprising:

an energy transfer element, comprising an energy transfer input end and an energy transfer output end coupled to the output of the power supply;

a power control circuit comprising a energy control circuit coupled to the energy transfer element;

a dimming circuit comprising a switching element and a dimming control circuit, in which the switching element is coupled to the power control circuit, the dimming control circuit is coupled to the switching element and receives a dimming signal, and switches the switching element in response to the dimming signal, the power control circuit increases a frequency of the AC output to a frequency range in response to switching of the switching element, and turns off the power supply when the frequency exceeds a pre-determined value;

a photo coupler coupled to the switching element and the power control circuit, in which the photo coupler generates a coupling signal in response to turn-on mode of the switching element, the power control circuit increases the frequency of the AC output to the frequency range in response to the coupling signal, and turns off the power supply when the frequency exceeds the pre-determined value; and an over-voltage detect circuit coupled to the output of the power supply and the photo coupler, driving the photo coupler to generate the coupling signal in response to the output of the power supply.

10. A power supply, having an alternating current (AC) output for supplying power to a lamp, the power supply comprising:

an energy transfer element, comprising an energy transfer input end and an energy transfer output end coupled to the output of the power supply;

a power control circuit comprising a energy control circuit coupled to the energy transfer element;

a dimming circuit comprising a switching element and a dimming control circuit, in which the switching element is coupled to the power control circuit, the dimming control circuit is coupled to the switching element and receives a dimming signal, and switches the switching element in response to the dimming signal, the power control circuit increases a frequency of the AC output to a frequency range in response to switching of the switching element, and turns off the power supply when the frequency exceeds a pre-determined value; and a high high-frequency current detection circuit comprising:

a first capacitive element, coupled to the AC output of the power supply, being adapted to receive a current of the AC output;

a resistor connected to the first capacitive element in series; and a second capacitive element connected to the resistor in parallel;

wherein, in response to a frequency variation of the current, the first capacitive element and the second capacitive element are adapted to generate a high-frequency current detecting signal in a junction of the resistor and the first capacitive element, and the power control circuit is configured to turn off the power supply when the frequency exceeds a high-frequency reference.

11. The power supply as claimed in claim 10, wherein the high-frequency current detection circuit further comprises a first direction element, coupled to the connection, and the power control circuit receives the high-frequency current detecting signal via the first direction element.

12. The power supply as claimed in claim 10, wherein the high-frequency current detection circuit further comprises a second direction element connected to the resistor and the second capacitive element in parallel, and coupled to the first direction element.

13. A power supply, having an alternating current (AC) output for supplying power to a lamp, the power supply comprising:

an energy transfer element, comprising an energy transfer input end and an energy transfer output end coupled to the output of the power supply;

a power control circuit comprising a energy control circuit coupled to the energy transfer element;

a dimming circuit comprising a switching element and a dimming control circuit, in which the switching element is coupled to the power control circuit, the dimming control circuit is coupled to the switching element and receives a dimming signal, and switches the switching element in response to the dimming signal, the power control circuit increases a frequency of the AC output to a frequency range in response to switching of the switching element, and turns off the power supply when the frequency exceeds a pre-determined value; and a current adjusting circuit comprising:

a temperature sensing module, being configured to sense an environment temperature and to generate a sensing voltage signal in response to the environment temperature; and a feedback circuit, coupled to the temperature sensing module, being configured to generate a feedback signal in response to the sensing voltage signal, the feedback signal being adapted to modulate the switching element by a switching frequency thereof to change the frequency of the AC output.

14. The power supply as claimed in claim 13, wherein the current adjusting circuit decreases the frequency of the AC output as the environment temperature decreases.

15. The power supply as claimed in claim 13, wherein the temperature sensing module of the current adjusting circuit comprises one of a positive temperature coefficient element, a negative temperature coefficient element, a diode, and a combination thereof.

* * * * *